US005660561A

United States Patent [19]

Tseng

[11] Patent Number: 5,660,561

[45] Date of Patent: Aug. 26, 1997

[54] LAMP BULB SOCKET

[76] Inventor: Wen-Ling Tseng, No. 30, Lane 281, Tong-Nang St., Hsinchu, Taiwan

[21] Appl. No.: 603,040

[22] Filed: Feb. 16, 1996

[51] Int. Cl.[6] ..... H01R 4/24

[52] U.S. Cl. ..... 439/419; 439/340

[58] Field of Search ..... 439/419, 414, 439/356, 360, 375, 744, 746, 747, 340

[56] References Cited

U.S. PATENT DOCUMENTS

| | | | |
|---|---|---|---|
| 3,251,023 | 5/1966 | Schick | 439/414 |
| 5,474,467 | 12/1995 | Chen | 439/419 |
| 5,573,419 | 11/1996 | Chen | 439/419 |

*Primary Examiner*—David L. Pirlot
*Assistant Examiner*—Tho D. Ta
*Attorney, Agent, or Firm*—Meltzer, Lippe, Goldstein, et al.

[57] ABSTRACT

A lamp bulb socket include a socket body having a bore to receive therein the base of a lamp bulb. An inner threading is provided on a surface of the bore which is defined by a helical slot surrounding the bore intervened with a helical rib. A chamber is provided in the socket body to be in communication with the bore through access openings defined by portions of helical slot. A cylindrical neutral contact member is received within the chamber to be contactable by the base of the bulb through the access openings. The neutral contact member is retained within the chamber by portions of the helical rib that are intervened between the access openings. The socket body has a central through hole formed on the bottom thereof to receive therein a cylindrical hot contact member with an inner end of the hot contact member exposed within the bore. A concave member configured in accordance with the tip of the bulb base is integrally formed on the inner end of the hot contact member to snugly receive therein the tip of the bulb base. Both the neutral contact member and hot contact member have a sharpened tip projecting out of the bottom of the socket body to pierce into electrical wires to establish electrical connections therewith. An end cap is provided to secure the cable to the bottom of the socket body.

10 Claims, 8 Drawing Sheets

LAMP BULB SOCKET

FIELD OF THE INVENTION

The present invention relates to a lamp bulb socket structure.

BACKGROUND OF THE INVENTION

Bulb sockets are to provide electrical connection between a power source and a lamp bulb. The bulb socket, as illustrated in FIG. 1, conventionally comprises a socket body having an inner-threaded bore into which a bulb 12 is threadingly engaged. The socket body 10 has two through holes 14 and 16 provided on a bottom thereof into which a hot plate 18 and a neutral plate 20 are inserted, respectively, to such positions contactable by the side contact and tip contact of the bulb 12. To secure a good electrical contact with the tip contact of the bulb 12, the hot plate 18 has a bent section 22 which is located just under the tip contact of the bulb 12. Both the hot plate 18 and neutral plate 20 have a sharpened tip 24 and 26 which, when the two plates 18 and 20 are inserted into the holes 16 and 14 of the socket body 10, are exposed so that when an electrical cable 28 are placed within a transverse slot 30 formed on the bottom of the socket body 10 and secured thereto by means of an end cap 32, the sharpened tips 24 and 26 pierce into the cable 28 to establish electrical connection therewith. The end cap 32 is provided with two opposite paws 34 which are to be received within corresponding slots 36 provided on the bottom of the socket body 10 to retain the end cap 32 on and thus secure the cable 28 to the bottom of the socket body 10.

Such a lamp bulb socket structure that is illustrated in FIG. 1 has been widely known and used, for example U.S. Pat. Nos. 4,778,409, 5,017,877, 5,350,315, 5,380,215 and 5,389,008. Nevertheless, several disadvantages are associated with such a conventional structure, such as:

(1) once the hot plate 18 and/or neutral plate 20 undergo un-desired deformation, it is very likely that a firm contact engagement between the bulb 12 and the plates 18 and 20 may not be maintained;

(2) the neutral plate 20 that is received within the hole 14 may get bent to inadvertently contact the hot plate 18 so as to cause short-circuiting.

(3) Since the hot plate 18 needs a bent section 22, the assembly of the hot plate 18 in the socket body 18 is more complicated due to the second operation applied thereon to form the bent section 22 after the hot plate 18 that is originally not bent is inserted into the corresponding hole 16.

In view of the above discussed and other disadvantages of the conventional lamp bulb socket structure, such as the one illustrated in FIG. 1, it is desirable to provide an improvement of the lamp bulb socket structure over the conventional structure to overcome the disadvantages and drawbacks thereof.

SUMMARY OF THE INVENTION

An object of the present invention is to provide a lamp bulb socket which is less likely to loss contact engagement between the base of the bulb and conductive plates of the socket.

Another object of the present invention is to provide a lamp bulb socket which has lower potential risk in causing short-circuiting.

Yet a further object of the present invention is to provide a lamp bulb socket which can be manufactured without a second time manufacturing operation in bending the conductive plate and thus providing a more efficient manner in manufacturing the lamp bulb socket.

In accordance with the present invention, there is provided a lamp bulb socket comprising a socket body having a bore to receive therein the base of a lamp bulb. An inner threading is provided on a surface of the bore which is defined by a helical slot surrounding the bore intervened with a helical rib. A chamber is provided in the socket body to be in communication with the bore through access openings defined by portions of helical slot. A cylindrical neutral contact member is received within the chamber to be contactable by the base of the bulb through the access openings. The neutral contact member is retained within the chamber by portions of the helical rib that are intervened between the access openings. The socket body has a central through hole formed on the bottom thereof to receive therein a cylindrical hot contact member with an inner end of the hot contact member exposed within the bore. A concave member configured in accordance with the tip of the bulb base is integrally formed on the inner end of the hot contact member to snugly receive therein the tip of the bulb base. Both the neutral contact member and hot contact member have a sharpened tip projecting out of the bottom of the socket body to pierce into electrical wires to establish electrical connections therewith. An end cap is provided to secure the cable to the bottom of the socket body.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 2:
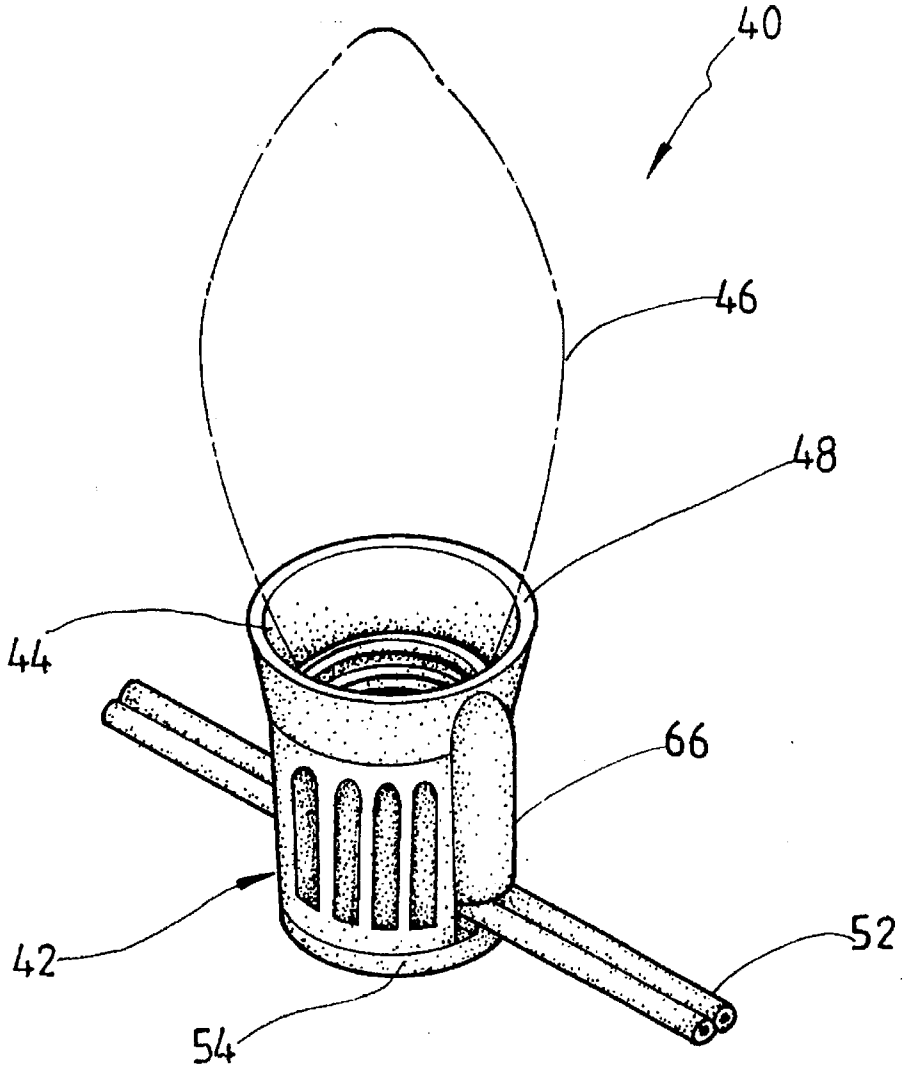
FIG. 2 is a perspective view showing a lamp bulb socket constructed in accordance with the present invention.
Figure 3:
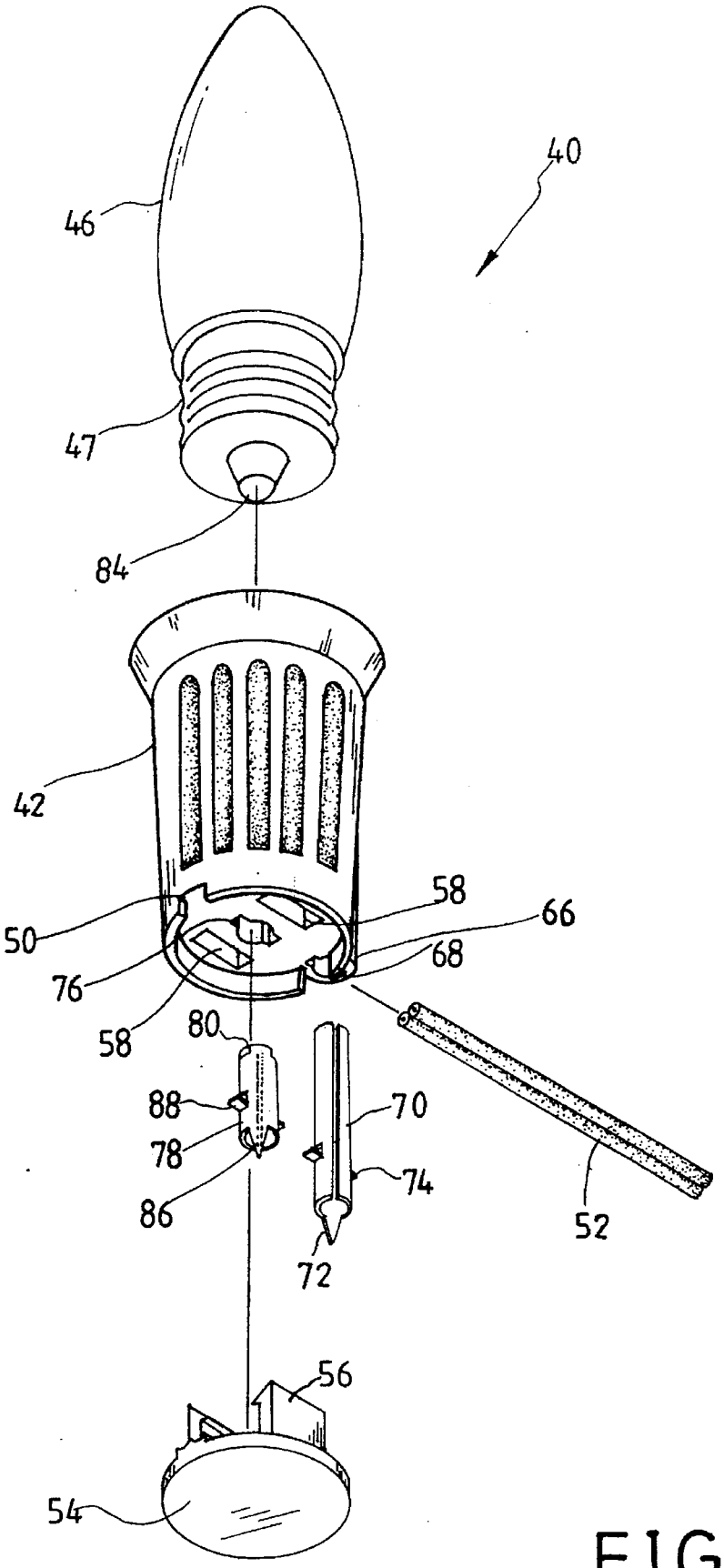
FIG. 3 is an exploded perspective view showing the lamp bulb socket of the present invention.
Figure 4:
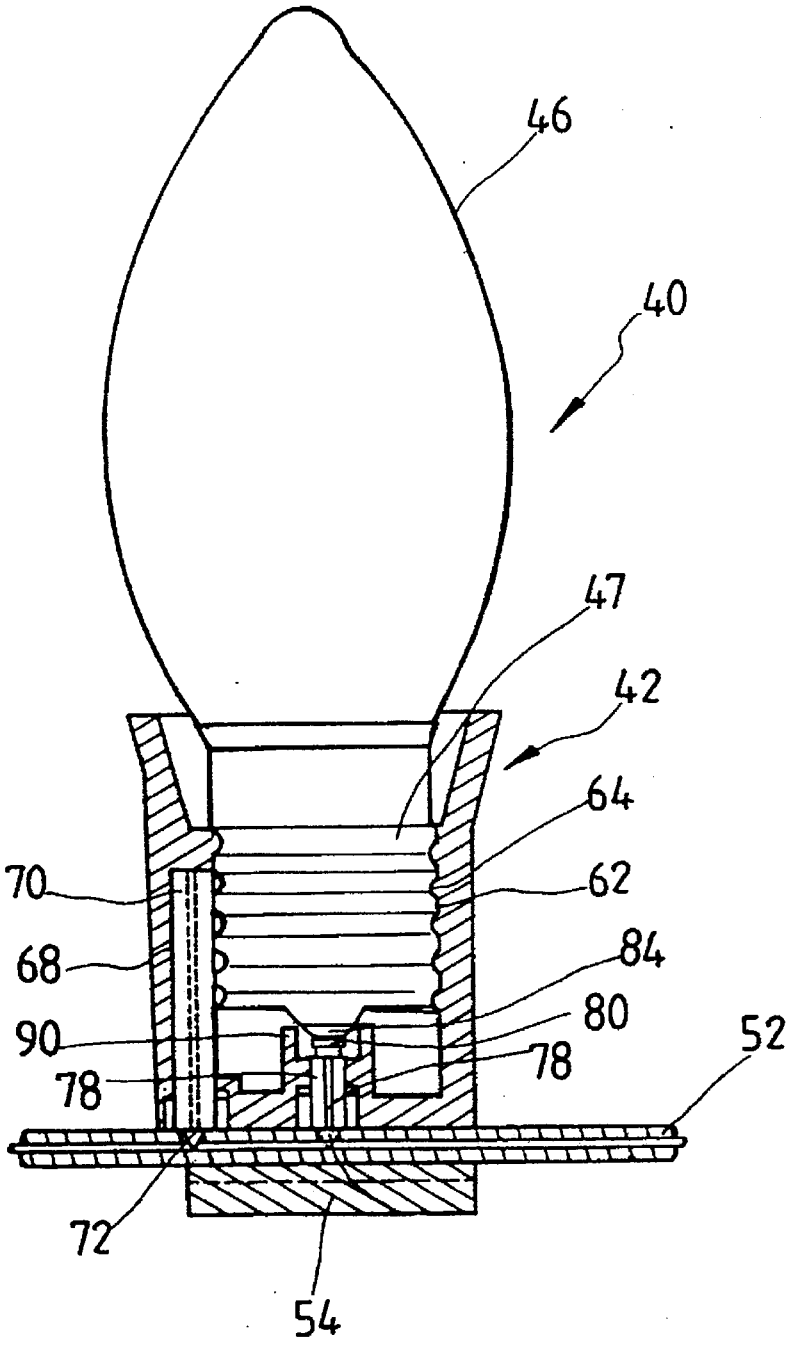
FIGS. 4 and 5 are cross-sectional views showing the lamp bulb socket of the present invention taken along different sections.

With reference to the drawings and in particular to FIGS. 2 and 3, wherein a lamp bulb socket constructed in accordance with the present invention, generally designated with the reference numeral 40, is shown, the lamp bulb socket 40 of the present invention comprises a socket body 42 defining a bore 44 for receiving therein a base 47 of a bulb 46 (also see FIGS. 3 and 4). The bore 44 has an open top end 48 for the entry of the bulb base 47. The socket body 42 has formed on a closed bottom end, opposite to the top opening 48, a transverse channel 50 (FIG. 2) within which an electrical cable 52 which may be the kind that is known to be constituted by two sheathed wires is placed. Art end cap 54 is provided to secure the cable 52 to the socket body 42 by having paws 56 having hook-like ends received inserted into and engaging with corresponding retaining slots 58 formed on the bottom end of the socket body 42.

Further referring to FIGS. 4–8, the socket body 42 comprises a hollow cylindrical member which defines the bulb receiving bore 44. The bore 44 has an inner surface on which helical threading 60 is formed which is defined by a helical slot 62, intervened with a helical rib 64, surrounding the bore 44. The threading 60 is dimensioned in accordance with the external threading of the base 47 of the bulb 46 for threadingly engage and retain the base 47 of the bulb 46.

Figure 9:
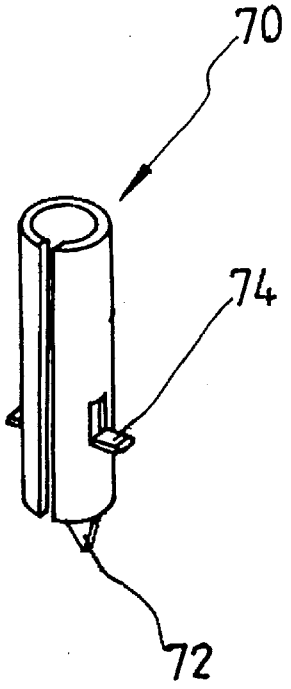
FIGS. 9 and 10 are perspective views showing the neutral contact member and hot contact member adapted in the lamp bulb socket of the present invention.
Figure 10:
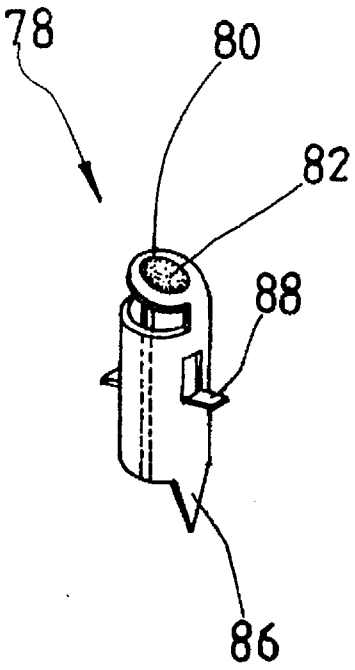

The socket body 42 has a side projection 66 (best shown in FIG. 2) extending along an axial direction of the socket body 42, inside which a chamber 68 is formed. A neutral contact member 70 (also see FIG. 9), preferably in the form of a cylinder, is received within the chamber 68. The chamber 68 is formed within the side projection 66 of the socket body 42 so that access openings are provided between the bore 44 and the chamber 68 by means of the portions of the helical slot 62 that are located corresponding to the side projection 66. Thus the chamber 68 is in communication with the bore 44 of the socket body 42 through the access openings defined by the portions of the helical slot 62 with the portions of the helical rib 64 that are located corresponding to the side projection 66 and thus intervening the access openings define confining means to confine the neutral contact member 70 within the chamber 68 while allowing the neutral contact member 70 to be contact-engageable by the base 47 of the bulb 46 through the access openings. With such an arrangement, the neutral contact member 70 is prevented from un-desirably leaning into the bore 44 and thus effectively eliminating the potential risk of short-circuiting.

Figure 1:
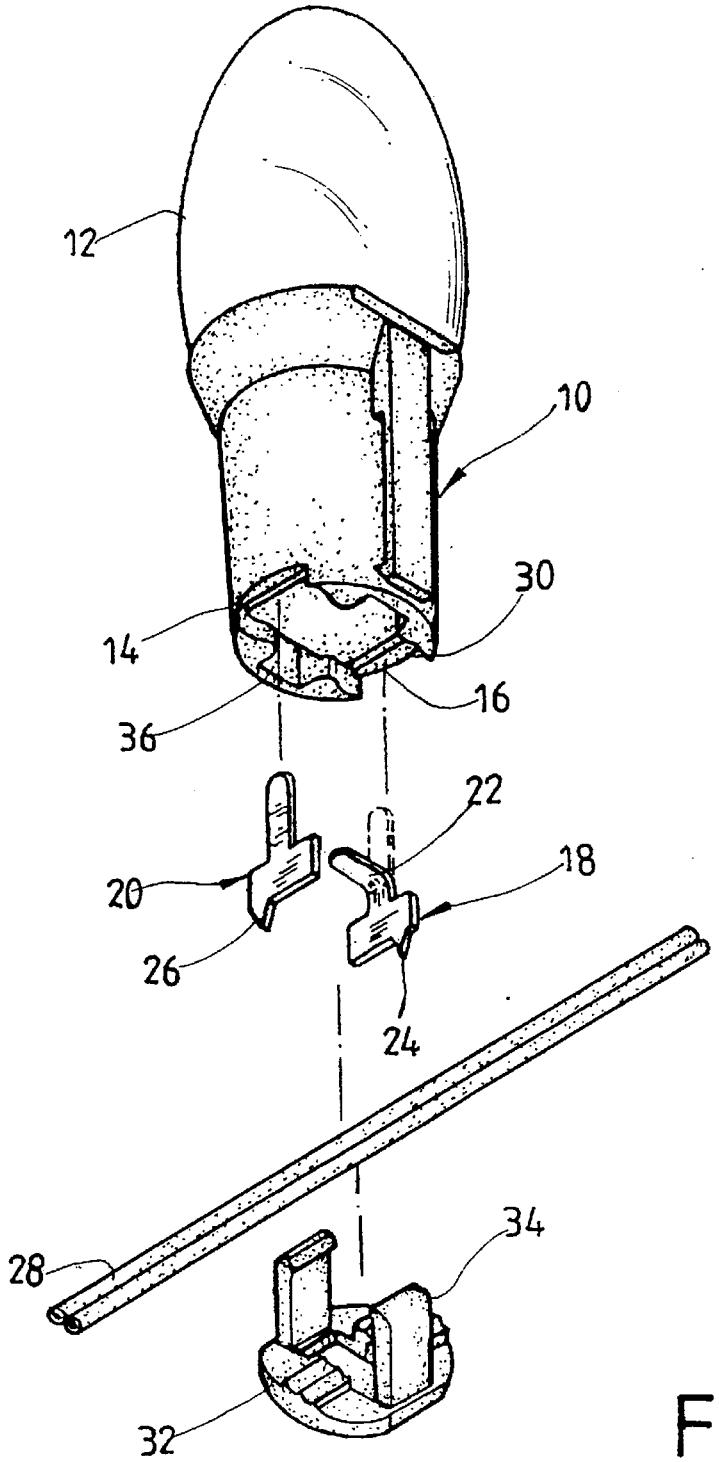
FIG. 1 PRIOR ART
FIG. 1 is an exploded perspective view showing a prior art lamp bulb socket.

The cylindrical configuration of the neutral contact member 70 which has a cross section occupies a substantially two-dimensional area provides the neutral contact member 70 with a greater structural strength, as compared to the thin plate structure of the conventional neutral plate shown in FIG. 1, of which the cross-sectional area is substantially a one-dimensional area.

The neutral contact member 70 has a sharpened tip 72 which projects out of the chamber 68 at the bottom of the socket body 42 to pierce into one of the wires of the cable 52 when the end cap 54 is secured to the bottom of the socket body 42.

Preferably, the cylindrical neutral contact member 70 is provided with two opposite sideways lugs 74 for more securely fixing the neutral contact member 70 within the chamber 68.

Figure 5:
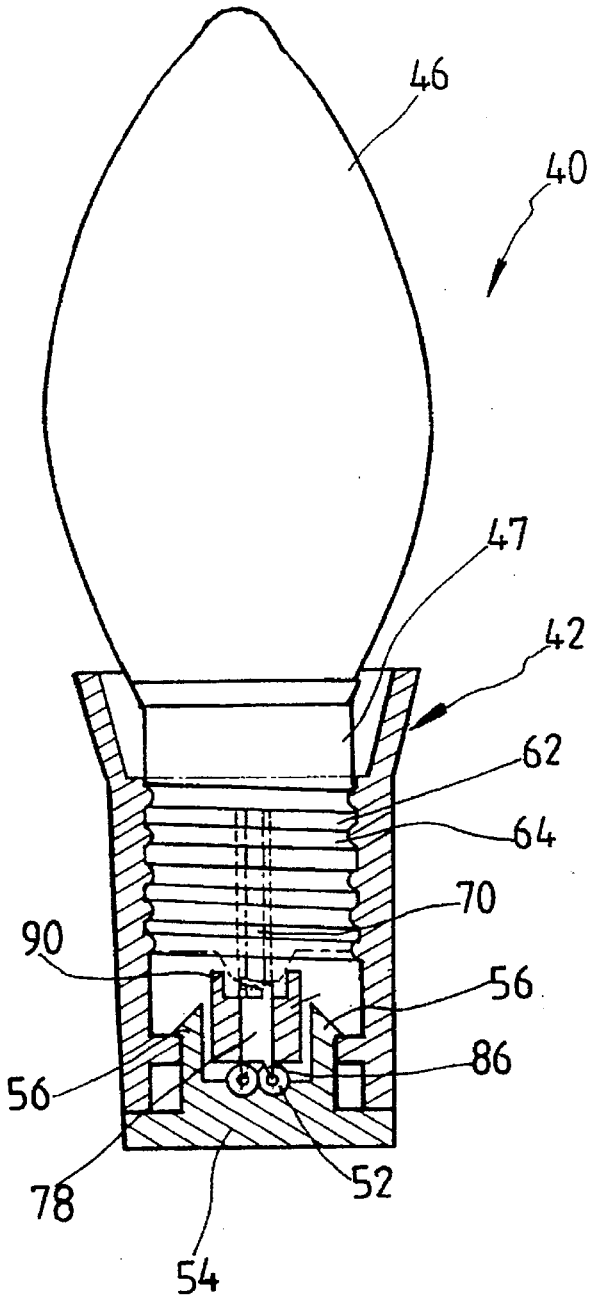
Figure 6:
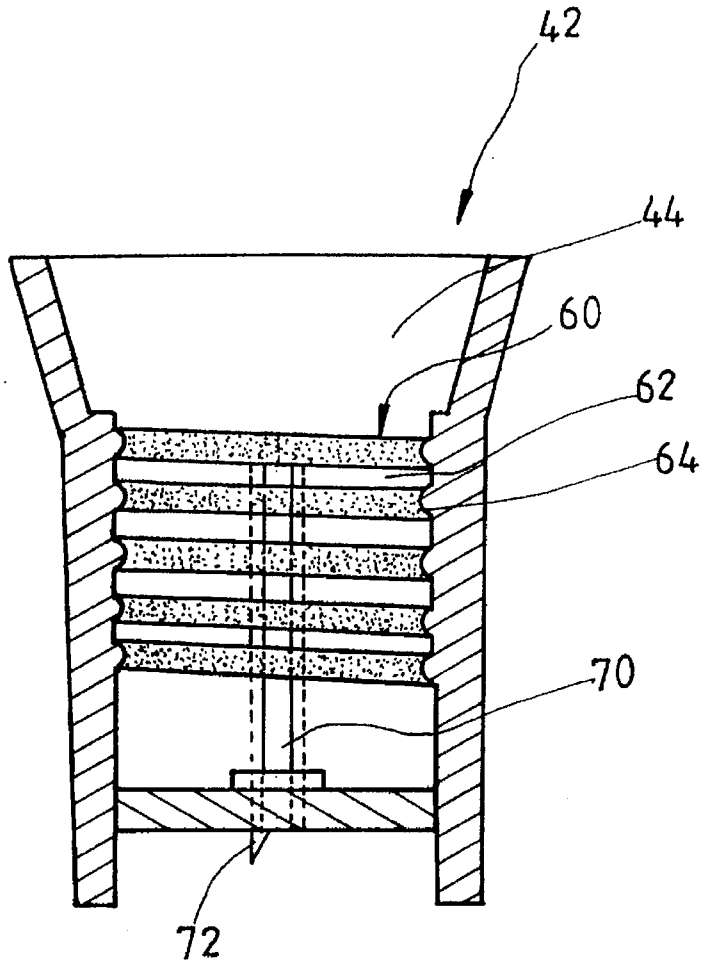
FIG. 6 is cross-sectional view showing the socket body of the lamp bulb socket of the present invention.
Figure 8:
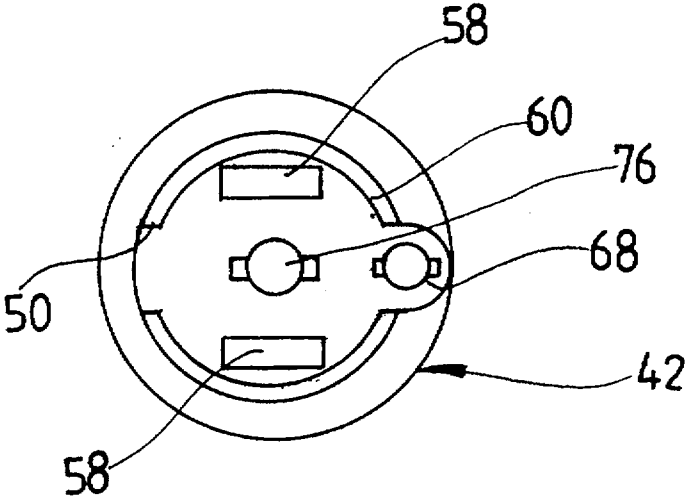
FIG. 8 is a bottom view of the socket body of the lamp bulb socket of the present invention.
Figure 7:
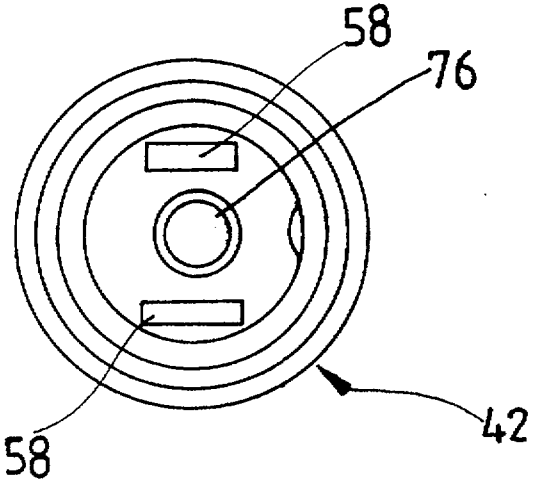
FIG. 7 is a top view of the socket body of the lamp bulb socket of the present invention.

The socket body 42 is also provided with a central through hole 76 at the bottom thereof into which a hot contact member 78, preferably in the form of a cylinder, a received. The hot contact member 78 has formed on a top end thereof a concave member 80 which is integrally connected to the hot contact member 78 and define a concave cavity 82 (also see FIG. 4) configured in accordance with the tip 84 of the base 47 of the bulb 46 to allow the tip 84 of the bulb base 47 to be snugly seated therein when the bulb 46 is inserted into the bore 44 of the socket body 42, as shown in FIGS. 4 and 5. This arrangement provides a better contact engagement between the hot contact member 78 and the tip 84 of the bulb base 47 so as to reduce the possibility of poor electrical contact that would occur in the prior art.

Preferably, the central through hole 76 has a circumferential flange 90 located inside the bore 44 of the socket body 42 and having an upper end located at a position substantially higher than the concave member 80 located within the central through hole 76 to serve as a shield which effectively prevents a user from inadvertently touching the hot contact member 78 and thus causing electrical shock to the user.

The hot contact member 78 is provided with a sharpened tip 86 which projects out of the central through hole 76 of the socket body 42 at the bottom thereof to pierce into the other one of the wires of the cable 52 to establish electrical connection therewith.

Preferably, the hot contact member 78 is provided with two opposite sideways lugs 88 for more securely fixing the hot contact member 88 within the central through hole 76 of the socket body Similarly, the cylindrical configuration of the hot contact member 78 provides a cross section occupying a substantially two-dimensional area which in turn provides the hot contact member 78 with a greater structural strength, as compared to the thin plate structure of the conventional neutral plate shown in FIG. 1, of which the cross-sectional area is substantially a one-dimensional area.

Certainly, other configuration rather than cylinder that occupies a two-dimensional cross section and thus provide a great structural strength may be used to replaced the cylindrical contact member 70 and 78 adapted in the present invention.

In assembly, the neutral contact member 70 and the hot contact member 78 are inserted into the chamber 68 and the central through hole 76 to have them seated therein by means of the lugs 74 and 88 with the sharpened tips 72 and 86 exposed out of the bottom of the socket body 42. The concave member 80 of the hot contact member 78 is arranged to be located within the bore 44, but shielded by the circumferential flange 90, so as to be contactable by the tip 84 of the bulb 46 and with such an arrangement of the concave member 80, there is no need to bend the hot contact member 78 after inserted into the central through hole 76 as is required in the prior art structure illustrated in FIG. 1.

Although a preferred embodiment has been described to illustrate the present invention, it is apparent that changes and modifications in the specifically described embodiment can be carried out without departing from the scope of the invention which is intended to be defined only by the appended claims.

What is claimed is:

1. A lamp bulb socket comprising a cylindrical socket body defining therein a bore with an open top end for an entry of a base of a bulb and a closed bottom end on which a central through hole is provided, the bore having an inner surface on which threading is provided and defined by a helical slot surrounding the bore and intervened by a helical rib, a chamber being provided in the socket body so as to be in communication with bore through access openings defined by portions of the helical slot, a neutral contact member being received within the chamber to be contactable by the base of the bulb through the access openings defined by the portions of the helical slot, the neutral contact member having a tip projecting out of the chamber at the bottom of the socket body to be electrically connected to an electrical wire, a hot contact member being received within the central through hole of the socket body to have an end exposed within the bore of the socket body and a tip projecting out of the central through hole to electrically connect to an electrical wire, the hot contact member having a concave member configured in accordance with a tip of the base of the bulb integrally connected the end thereof within the bore to receive and thus electrically contact the tip of the bulb base therein.

2. The lamp bulb socket as claimed in claim 1, wherein each of the neutral contact member and the hot contact member has sideways lugs provided thereon to more securely fix the neutral contact member and the hot contact member within the chamber and the central through hole of the socket body.

3. The lamp bulb socket as claimed in claim 1, wherein the central through hole of the socket body comprises a circumferential flange located within the bore and having a top end substantially higher than the end of the hot contact member that is exposed within the bore of the socket body.

4. The lamp bulb socket as claimed in claim 1, wherein the hot contact member comprises a body having a cross section substantially occupying a two-dimensional area so as to provide a great structural strength.

5. The lamp bulb socket as claimed in claim 4, wherein the hot contact member comprises a cylindrical body and has a circular cross section.

6. The lamp bulb socket as claimed in claim 1, wherein the neutral contact member comprises a body having a cross section substantially occupying a two-dimensional area so as to provide a great structural strength.

7. The lamp bulb socket as claimed in claim 6, wherein the neutral contact member comprises a cylindrical body and has a circular cross section.

8. The lamp bulb socket as claimed in claim 1, wherein the socket body has a channel provided on the bottom end thereof to receive therein an electrical cable having two sheathed wires and wherein each of the neutral contact member and the hot contact member has a sharpened tip projecting out of the bottom of the socket body to respectively pierce into the wires to establish electrical connections therewith.

9. The lamp bulb socket as claimed in claim 8, wherein the socket further comprises an end cap secured to the bottom end of the socket body to retain the cable on the bottom end of the socket body.

10. The lamp bulb socket as claimed in claim 9, wherein the end cap has paws provided thereon to be received and retained within corresponding slots provided on the bottom end of the socket body to secure the end cap to the socket body.

* * * * *